US005090466A

United States Patent [19]

Hong

[11] Patent Number: 5,090,466

[45] Date of Patent: Feb. 25, 1992

[54] PLEATED WINDOW SHADE

[76] Inventor: Amy Hong, No. 9, Jenn-Shing Lane, Fu-Nan Village, Fu-Shing Hsiang, Changhua Shiann, Taiwan

[21] Appl. No.: 719,437

[22] Filed: Jun. 24, 1991

[51] Int. Cl.[5] ..... E06B 3/94

[52] U.S. Cl. ..... 160/84.1; 160/115

[58] Field of Search ..... 160/84.1, 113, 114, 160/115, 87

[56] References Cited

U.S. PATENT DOCUMENTS

| | | | |
|---|---|---|---|
| 3,946,788 | 3/1976 | van Mayen | 160/84.1 |
| 4,687,039 | 8/1987 | Chumbley | 160/84.1 |
| 4,953,610 | 9/1990 | Phillips | 160/84.1 |
| 5,054,534 | 10/1991 | Hong | 160/84.1 |

*Primary Examiner*—Blair M. Johnson
*Attorney, Agent, or Firm*—Browdy and Neimark

[57] ABSTRACT

A pleated window shade comprises mainly an upper rail, a bottom rail, a full blind having a plurality of folded parts with rows of string holes disposed therewith, and narrow blinds equal in number to rows of string holes of the full blind. The narrow blinds are composed of folded parts, each of which comprises at least one string hole to accommodate therein a string. The narrow blinds are arranged between the upper rail and the bottom rail in a manner that their positions are correspondent to those to rows of string holes of full blind, with string holes of narrow blind and of full blind being positioned in an alternate manner so as to obstruct one another.

1 Claim, 3 Drawing Sheets

PLEATED WINDOW SHADE

BACKGROUND OF THE INVENTION

The present invention relates to a window shade, and more particularly to a pleated window shade designed to keep out light effectively.

The folded parts of a pleated window shade of prior art comprises at least two straight and vertical rows of holes designed to accommodate therein the strings intended for use in pulling the shade up or down. The pleated window shade of prior art as such is defective in design in that its string holes permit sunlight or the light of other sources to enter the room when it is pulled down to keep out light, and that its string holes are always culprits through which the objects in the room at night are prone to project out so that privacy is compromised. In addition, the string holes can be used improperly as peep holes.

SUMMARY OF THE INVENTION

It is therefore the primary objective of the present invention to provide a pleated window shade that does keep out light.

In keeping with the principles of the present invention, the primary objective of the present invention is accomplished by a pleated window shade, which comprises mainly an upper rail, a bottom rail, a full blind having thereon a predetermined number of folded parts. The full blind is attached to the upper rail and the bottom rail at both ends thereof. Each of folded parts contains at least one string hole through which a string is disposed for controlling the up-and-down movement of the blind. The pleated window shade of the present invention is characterized in that it further comprises rows of narrow blinds equal in number to the row number of the string holes disposed in the folded parts of the full blind. Each narrow blind is identical with the full blind in terms of structure and is arranged in such ways that its position is corresponding to that of the row of string holes of the full blind, and that the positions of their respective string holes are noncorresponding. As a result, the narrow blind serves to obstruct the string holes of the full blind and vice versa.

DETAILED DESCRIPTION OF THE PREFERRED EMBODIMENT

Figure 1:
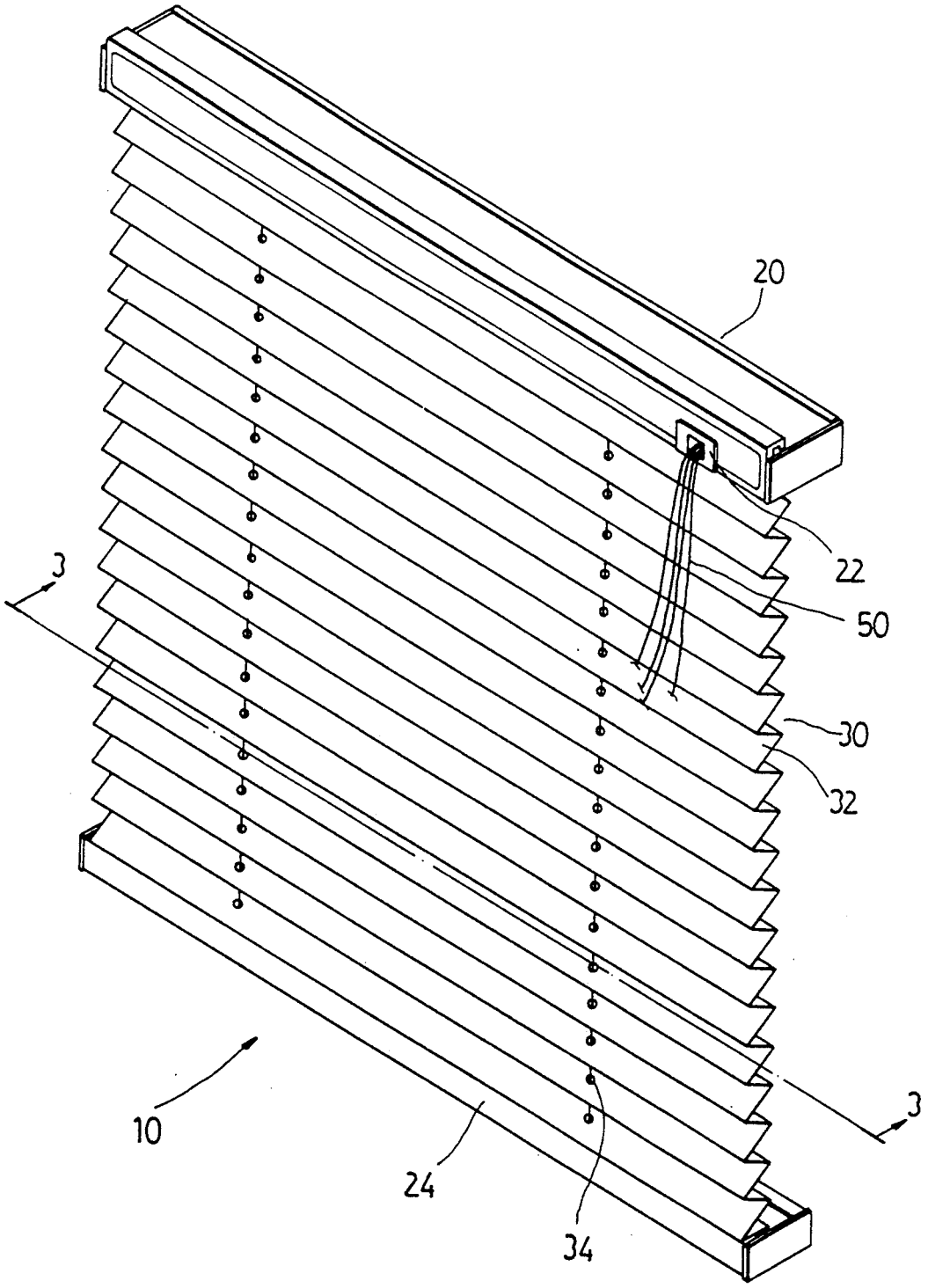
FIG. 1 shows a three-dimensional view of the preferred embodiment of the present invention.
Figure 2:
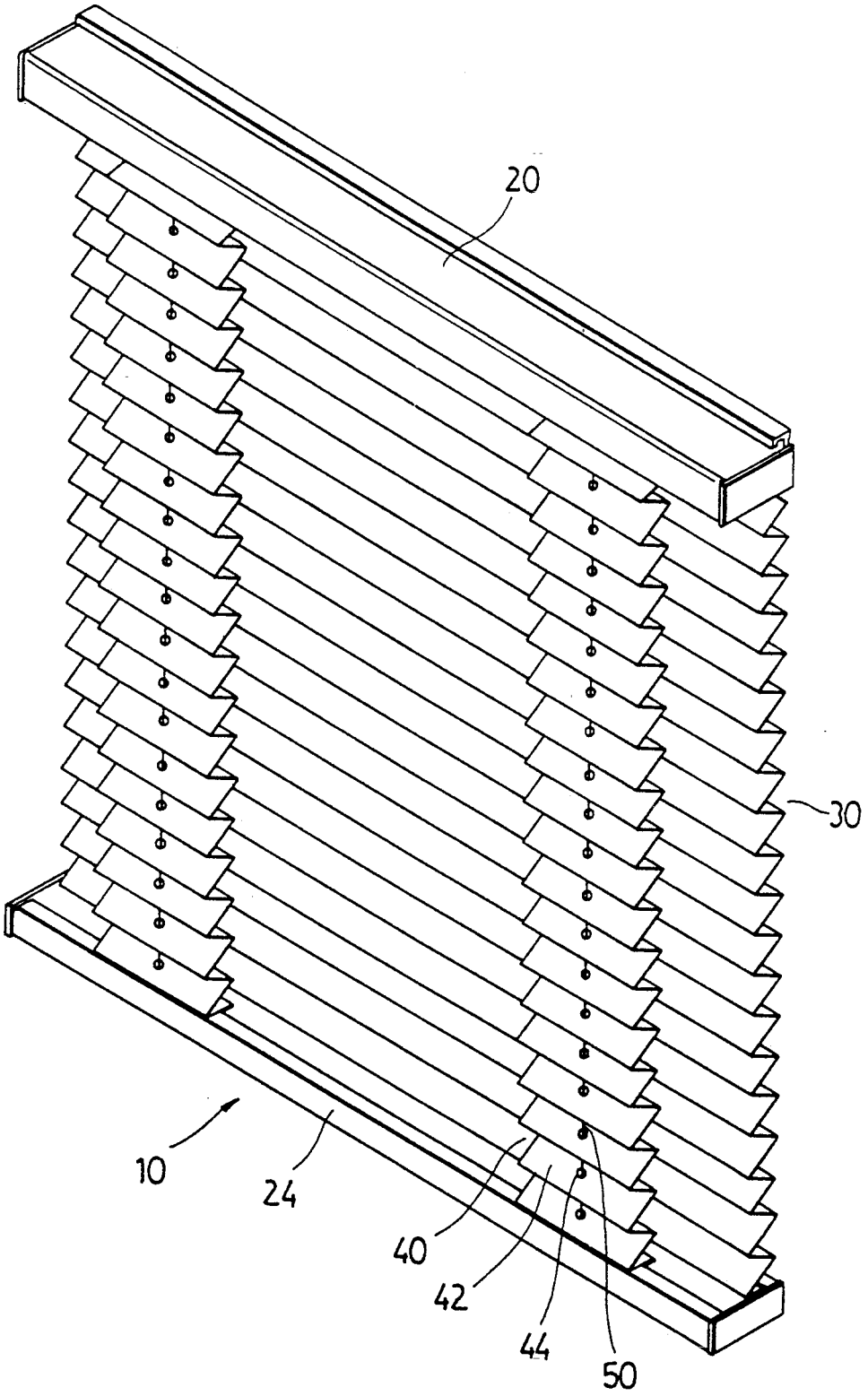
FIG. 2 shows a three-dimensional view taken from the back of the preferred embodiment as shown in FIG. 1.
Figure 4:
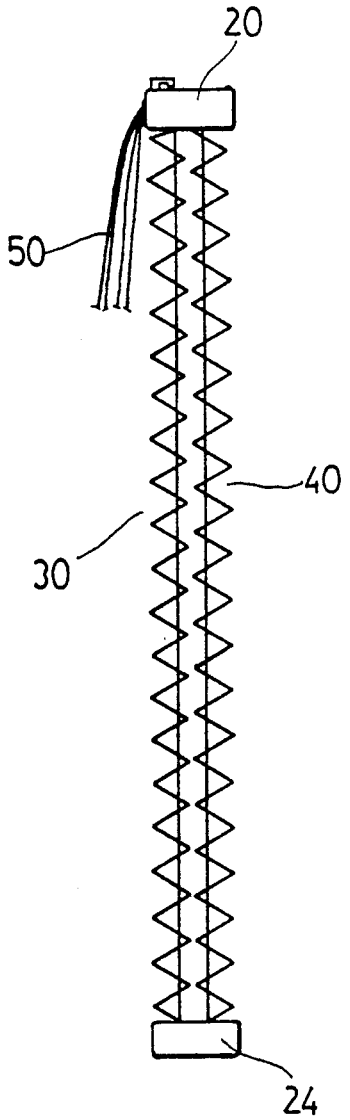
FIG. 4 shows a schematic view taken from the side of the preferred embodiment as shown in FIG. 1.

Referring to all drawings provided herewith, a pleated window shade 10 embodied in the present invention is shown comprising an upper rail 20 having a lift lock 22 disposed thereto at one end thereof, a bottom rail 24, a full blind 30, two narrow blinds 40, and a draw cord 50. Both upper rail 20 and bottom rail 24 contain therein receiving slots.

The full blind 30 comprises a predetermined number of folded parts 32 of equal size. Each side of folded parts 32 comprises a string hole 34. Both upper and bottom ends of the full blind 30 are adhered securely to boards (not shown in drawings) which in turn are lodged respectively in the receiving slots of upper rail 20 and bottom rail 24.

Two narrow blinds 40 of a predetermined width can be of the same color and material quality as the full blind 30. Each of two narrow blinds 40 is composed of a predetermined number of folded parts 42, with each of folded parts 42 having a string hole 44 disposed therewith so that each narrow blind 40 comprises a row of string holes 44. Each of narrow blinds 40 is arranged in such a manner that it is positioned correspondingly with the row of string holes 34 of the full blind 30. Both upper and bottom ends of narrow blinds 40 are also adhered firmly to the boards which are lodged in the receiving slots of upper rail 20 and bottom rail 24 and are also adhered to the full blind 30 as mentioned previously.

The width of each of narrow blinds 40 and full blind 30 is not to exceed the width of upper rail 20 and bottom rail 24.

The draw cord 50 consists of four strings, which are arranged seperately and singularly in two rows of string holes 34 of full blind 30 and two rows of string holes 44 of two narrow blinds 40. Each of four strings mentioned above is attached securely to bottom rail 24 at one end thereof. The other end of each of four strings passes through independently a row of string holes to emerge from the lift lock 22 of the upper rail 20.

Figure 3:
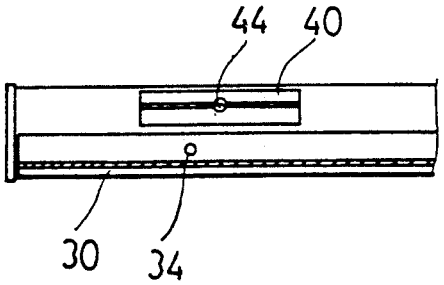
FIG. 3 shows a sectional view of the portion taken along line 3—3 as shown in FIG. 1.

The pleated window shade 10 of the present invention is arranged in a manner that its full blind 30 faces the interior of the room in which it is located. It is characterized in that it comprises two narrow blinds 40, with each having a row of string holes 44 which are positioned along with string holes 34 of full blind 30 in an alternate manner so as to obstruct one another, as shown in FIG. 3. It is therefore apparent that the light coming in through the string holes 44 of narrow blinds 40 from a source located outside the room can be effectively blocked by the full blind 30. Similarly, the pleated window shade 10 of the present invention can serve effectively to prevent the light originating in the room from passing through string holes thereof to the outside of the room.

It must be pointed out here that string holes 34 of full blind 30 and string holes 44 of narrow blinds 40 of the pleated window shade 10 of the present invention are arranged in alternate positions having a specific angle, which hinders the light to pass through string holes 44 of narrow blinds 40 and string holes 34 of full blind 30 in a reciprocating manner or by a diffraction of light. In addition, it is important that narrow blinds 40 of the pleated window shade 10 of the present invention are of an appropriate width so that an obstruction of light is effectively achieved.

Figure 5:
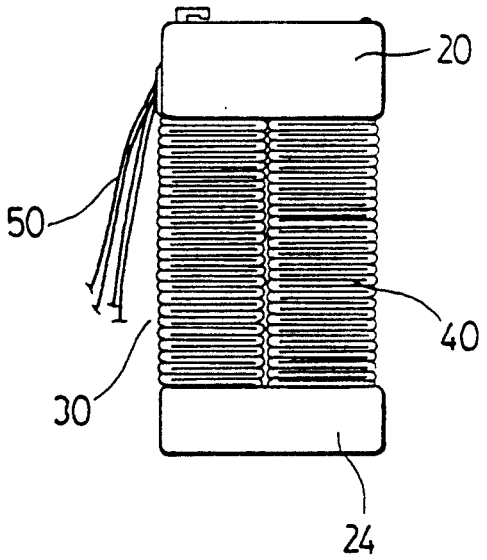
FIG. 5 shows a schematic view taken from the side of the preferred embodiment of the present invention in a state of collapse.

Like a conventional window shade of prior art, the plated window shade 10 of the present invention can be made compact by pulling the draw cord 50 to cause the bottom rail 24 to move upward, resulting in full blind 30 and narrow blinds 40 to fold together compactly between upper rail 20 and bottom rail 24, as shown in FIG. 5.

For the purpose of suiting personal taste, the color of narrow blinds 40 can be different from that of full blind 30 in order to enhance the esthetic effect of the pleated window shade 10 of the present invention. Furthermore, the pleated window shade 10 can be arranged in such a way that its narrow blinds 40 face the interior of the room in which it is located.

The embodiment of the present invention described above is to be considered in all respects as merely an illustration of principles of the present invention. Accordingly, the present invention is to be limited only by the scope of the hereinafter appended claims.

What I claim is:

1. A pleated window shade comprising an upper rail, a bottom rail, a full blind having a length and a width and a plurality of folded parts with rows of string holes disposed therewith, and narrow blinds equal in number to rows of string holes of said full blind, said narrow blinds being further characterized in that they are of a width which is less than said width of said full blind, and that they are composed of folded parts, with each of said folded parts having at least one string hole disposed therewith to accommodate therein a string, and further that they are arranged between said upper rail and said bottom rail in such a manner that their positions are correspondent to those of rows of string holes of said full blind, with string holes of said narrow blind and of said full blind being positioned in a laterally alternate manner.

* * * * *